US011882868B2

(12) United States Patent
Pavanetto et al.

(10) Patent No.: US 11,882,868 B2
(45) Date of Patent: Jan. 30, 2024

(54) APPARATUS FOR MAKING A SHEET OF MATERIAL COMPRISING VEGETABLE AND/OR ALKALOID SUBSTANCES

(71) Applicant: KÖRBER TECHNOLOGIES S.p.A., Paese (IT)

(72) Inventors: Jader Pavanetto, Venice (IT); Igor Bottacco, Feltre (IT)

(73) Assignee: KÖRBER TECHNOLOGIES S.P.A., Paese (IT)

( * ) Notice: Subject to any disclaimer, the term of this patent is extended or adjusted under 35 U.S.C. 154(b) by 0 days.

(21) Appl. No.: 17/970,989

(22) Filed: Oct. 21, 2022

(65) Prior Publication Data

US 2023/0130205 A1 Apr. 27, 2023

(30) Foreign Application Priority Data

Oct. 21, 2021 (IT) ..... 102021000027116

(51) Int. Cl.
*A24B 3/14* (2006.01)

(52) U.S. Cl.
CPC ..... *A24B 3/14* (2013.01)

(58) Field of Classification Search
CPC ..... A24B 3/14
See application file for complete search history.

(56) References Cited

U.S. PATENT DOCUMENTS 4,702,264 A 10/1987 Graves, Jr.
4,724,850 A * 2/1988 Graves, Jr. ..... A24B 3/14 131/370
4,730,629 A * 3/1988 Graves, Jr ..... A24B 3/14 131/369
4,754,767 A * 7/1988 Graves, Jr. ..... A24B 3/14 131/370
4,787,402 A * 11/1988 Leonard ..... A24B 3/14 131/369
6,095,959 A * 8/2000 Negrini ..... B08B 1/02 493/341

FOREIGN PATENT DOCUMENTS

CH 619744 A5 10/1980
DE 2103936 A1 9/1972
DE 3919087 A1 12/1990
JP 2004-27441 A 1/2004

OTHER PUBLICATIONS

Jul. 1, 2022 Italian Search Report and Written Opinion issued in Italian Patent Application No. IT202100027116.

* cited by examiner

*Primary Examiner* — Jason L Vaughan
(74) *Attorney, Agent, or Firm* — Oliff PLC

(57) ABSTRACT

An apparatus for making a sheet of material including vegetable and/or alkaloid substances including a roller rolling mill system including a plurality of rollers rotatable around respective rotation axes defining a rolling mill path provided with pressure lines adapted to substantially press the material so as to provide the latter with a sheet-like shape, and a scraping system configured to engage by contact the working surface of a transfer roller along a contact line so as to detach the material. Specifically, the scraping system including a closed-loop endless scraping band movable at the contact line parallel to the rotation axis of the transfer roller via an actuating assembly.

11 Claims, 4 Drawing Sheets

APPARATUS FOR MAKING A SHEET OF MATERIAL COMPRISING VEGETABLE AND/OR ALKALOID SUBSTANCES

TECHNICAL FIELD OF INVENTION

The present invention refers to an apparatus for making a sheet of material comprising vegetable and/or alkaloid substances. In particular, the present invention regards an apparatus associable with a system for the production of a single vegetable substance, or a mixture of different vegetable substances, in reconstituted form, such as for example tobacco in sheets for smoking articles, a sheet of hemp for medical or pharmaceutical uses, a sheet of aromatic plants for alimentary purposes, or for the production of an alkaloid substance, or a mixture of different alkaloid substances, in reconstituted form, or for the production of a mixture of vegetable and alkaloid substances, in reconstituted form.

The description which follows will refer, purely by way of example, to the production of a sheet of reconstituted tobacco. However, the apparatus according to the present invention can alike be used, in general, in the production of any vegetable and/or alkaloid substance in a reconstituted form.

BACKGROUND OF THE INVENTION

As is well known, shredded tobacco for cigarettes is made by putting tobacco leaves through various mechanical processes, such as for example threshing, crushing, sieving, drying and the like. However, such various processes produce a large quantity of tobacco powders, obviously in addition to the normal waste products, such as for example the ribs of the leaves, or very small pieces.

Through the years, the tobacco industry has developed processes and machines that make it possible to recycle powdered tobacco and other processing waste, obtaining thereby large sheets of reconstituted tobacco that are adapted to be crushed and mixed with the normal shredded tobacco for cigarettes. Recently, sheets of reconstituted tobacco are used in electronic devices that produce tobacco vapours without involving the combustion of tobacco.

One type of industrial process presently used to produce sheets of reconstituted tobacco provides for mixing of the powders obtained from grinding virgin tobacco and/or other sources of tobacco, such as for example by-products from tobacco processing and tobacco powders, so as to obtain a fine powder with particle sizes generally smaller than 350 micrometers. This fine powder is then mixed with water and a binding agent, generally cellulose-based, so as to obtain a mixture having a water content greater than 60%, and generally included between 70% and 80%.

The mixture thereby obtained is subsequently poured in continuous manner onto a conveyor belt so as to form, on the upper side of the belt, a thin layer of material that is then dried in an oven, so as to obtain a sheet of reconstituted tobacco that can subsequently be wound to form a coil. However, in this state it is not possible to reliably obtain a constant thickness of the resulting sheet.

A further type of industrial process presently utilized to produce the sheets of reconstituted tobacco provides for the mixture, obtained with the fine tobacco powder, water and a binding agents, to first be put through a rolling step through a plurality of rollers, and then to be detached from the last roller by means of a scraping device. In this state, it is possible to obtain in a reliable manner a constant thickness of the formed sheet.

For example, the U.S. Pat. No. 4,702,264 document describes a method and an apparatus comprising a roller rolling mill system and a scraping device. In the roller rolling mill system, the rollers are adapted to receive said mixture, or material, that adheres to the respective surfaces. The rollers are arranged in succession with one adjacent and substantially tangent to the other, defining a rolling mill path along which are provided pressure lines between adjacent rollers. These pressure lines are adapted to press the material so as to give the material a sheet-like shape. Thus, the scraping system is configured to engage by contact the surface of the last roller so as to detach from the surface of the latter the material having said sheet-like shape.

Although such prior-art apparatus works in many cases adequately, it presents some drawbacks.

In fact, since the sheet made with a continuous mode process, it is probable that, after a certain processing time interval, on the scraping device (in particular on its scraping element, such as a blade) there will be an accumulation or deposit of foreign bodies that, subsequently, will be transferred casually or regularly to the surface of the formed sheet. These foreign bodies, that therefore can consist of the same material as the sheet that accumulate on the blade or of other bodies and/or contaminating materials from the processing environment, create defects on the surface of the sheet, and degrade its quality.

To avoid this problem, it is necessary to provide frequent cleaning or maintenance of the scraping device that lead to frequent machine down times and, consequently, a decreased productivity of the apparatus and of the associated system.

However, in recent years, the tobacco industry is required to offer at the same time high quality of the reconstituted tobacco sheets, high productivity, and a greater constructive and maintenance simplicity of said apparatuses Consequently, there is the necessity of devising a solution that solves at least one of the previously described drawbacks.

SUMMARY OF THE INVENTION

One objective of the present invention is to provide an apparatus configured to effectively form a sheet with materials comprising vegetable and/or alkaloid substances.

In the scope of the above objective, one purpose of the present invention regards an apparatus configured to guarantee a reduction or an elimination of defects on the surface of the formed sheet.

A further purpose regards an apparatus that, in the design phase, provides versatility of configuration based on desirable characteristics of the roller rolling mill system.

A further purpose concerns an apparatus that guarantees an effective processing.

A further purpose concerns an apparatus that guarantees a high productivity.

A further purpose concerns an apparatus that provides for a simple construction.

An additional purpose deals with an apparatus that provides for simplicity of maintenance.

A further purpose concerns an apparatus wherein its construction allows a simple coupling with further equipment for subsequent processing steps carried out on the formed sheet.

The above objective and purposes, and others that will become more evident in the following description, are achieved by means of an apparatus as defined in claim 1.

Preferred embodiments are defined in the dependent claims.

BRIEF DESCRIPTION OF THE FIGURES

The further characteristics and advantages of the apparatus, according to the present invention, will become more evident from the following description relative to embodiments given without limitations purely by way of example, with reference to the following figures, wherein.

DETAILED DESCRIPTION OF THE INVENTION

Figure 1:
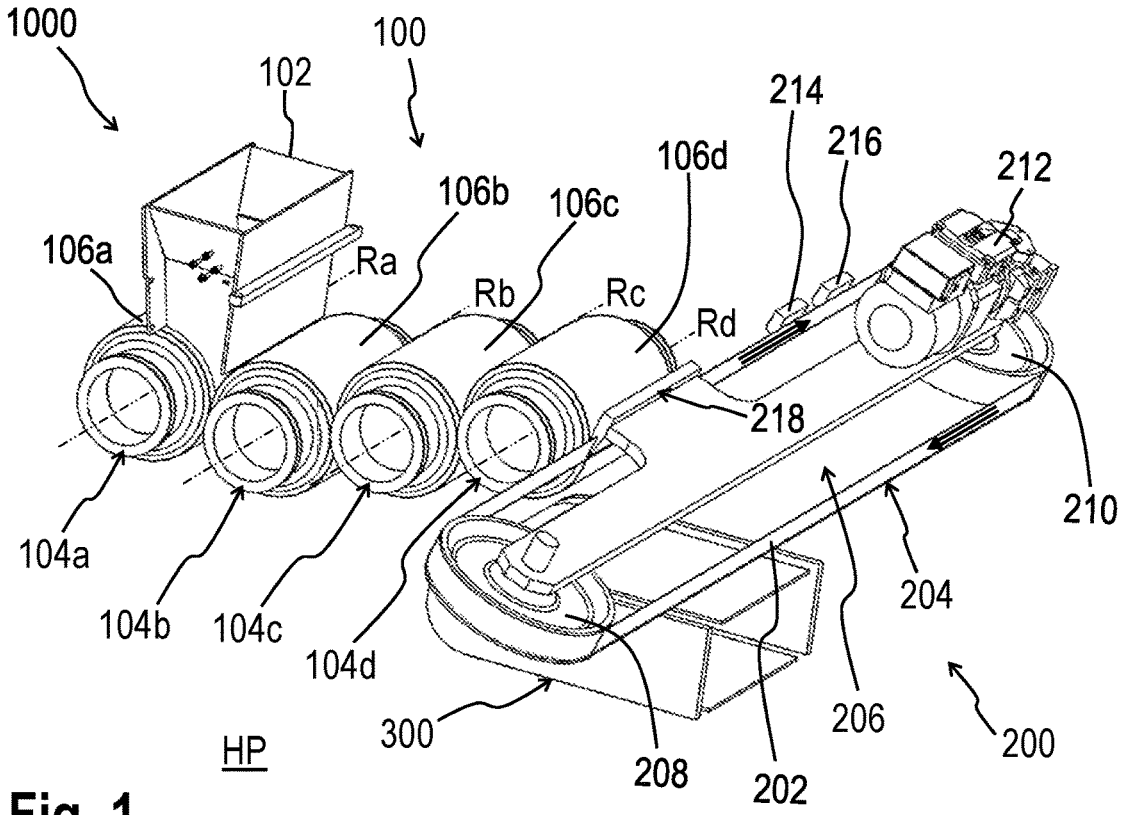
FIG. 1 is perspective schematic view of an apparatus according to a first preferred embodiment of the present invention.

The present invention refers to an apparatus for making a sheet of material comprising one or more vegetable and/or alkaloid substances. Preferably, said apparatus is adapted to produce a single vegetable substance, or a mixture of different vegetable substances, in a reconstituted form, such as for example tobacco in sheets for smoking articles, a sheet of hemp for medical or pharmaceutical uses, a sheet of aromatic plants for alimentary purposes, or for the production of an alkaloid substance, or a mixture of different alkaloid substances, in reconstituted form, or for the production of a mixture of vegetable and alkaloid substances, in reconstituted form.

The description which follows will refer to the production of a sheet of reconstituted tobacco. However, this reference will be intended as provided exclusively by way of non-limiting example, since the apparatus according to the present invention can be used in the production of any vegetable and/or alkaloid substance in a reconstituted form.

Moreover, in the description which follows, the term "rolling" refers to a production processing for consecutive plastic deformations, to which a plastically deformable material is subjected to make a sheet-like or leaf structure, having substantially a shape similar to a foil.

Moreover, in the following description, terms such as "above", "under", "upper", "lower" or similar ones refer to an apparatus according to the present invention in the normal working order, as shown in the enclosed figures.

In FIGS. 1 to 5 is shown an apparatus 1000 for making a sheet with material comprising vegetable and/or alkaloid substances, according to a first preferred embodiment of the present invention.

Preferably, the material comprising one or more vegetable and/or alkaloid substances is a mixed material formed with a blend comprising tobacco, water and a binding agent. Said blend is supplied to the apparatus 1000 preferably in the form of granules obtained, for example, through extrusion procedures and subsequent granulation. However, this selection is not limitative, and the form with which the blended mixture is supplied and the procedure with which it is obtained are not limitative. For example, the mixture can be supplied to the apparatus 1000 by pouring it.

The apparatus 1000 includes, substantially in succession in the following order, a roller rolling mill system 100, a scraping system 200 and, preferably, conveyor means 300.

The roller rolling mill system 100 is configured to give the material, by means of consecutive plastic deformations, a sheet-like shape having a desired thickness, as is better explained below.

The scraping system 200 is configured to detach from a roller of the roller rolling mill system 100 the material having said sheet-like shape, so as to make it available for subsequent processing steps.

The conveyor means 300 such as for example a conveyor belt, are configured to receive the material having said sheet-like shape, when it is detached from the roller of the roller rolling mill system 100 by means of the scraping system 200, and to convey it toward the subsequent processing steps, such as for example a drying step carried out by means of appropriate equipment.

The roller rolling mill system 100 comprises a plurality of rollers rotatable about respective rotation axes. The rotation axes of the rollers are parallel to each other and, preferably, parallel to a lying plane HP, substantially the horizontal lying plane, on which the apparatus 1000 lies.

In the first embodiment, the roller rolling mill system 100 includes four rollers. The four rollers comprise in succession, in the following order, a pair of feeding rollers: first feeding roller 104*a* and second feeding roller 104*b*, an intermediate roller 104*c* and a transfer roller 104*d*.

The transfer roller 104*d* is substantially the last roller to which the material operatively adheres, and from which it is detached by means of the scraping system 200, so as to make it available for the subsequent processing steps.

The rotation axes of the four rollers, from 104*a* to 104*d*, are respectively a first roller rotation axis Ra (hereafter also defined "first roller axis Ra"), a second roller rotation axis Rb (hereafter also defined "second roller axis Rb"), an intermediate roller rotation axis Rc (hereafter also defined "intermediate roller axis Rc"), and a transfer roller rotation axis Rd (hereafter also defined "transfer roller axis Rd" or "rotation axis of the transfer roller").

The rollers, from 104*a* to 104*d*, each comprise a shape substantially cylindrical and include lateral working surfaces, such as respectively a first roller working surface 106*a* (hereafter also defined as "first working surface 106*a*"), a second roller working surface 106*b* (hereafter also defined "second working surface 106*b*"), an intermediate roller working surface 106*c* (hereafter also defined as "intermediate working surface 106*c*"), and a transfer roller working surface 106*d* (hereafter also defined "transfer working surface 106*d*" or "working surface of transfer roller"). The working surfaces, from 106*a* to 106*d*, are preferably smooth and made of metallic material, however, this selection is not limitative.

The rollers, from 104*a* to 104*d*, provide for respective integral shafts (not shown in the figures) that define the respective rotation axes, from Ra to Rd. Preferably, the ends of said shafts are rotatably pivoted on adjustable support means (not shown in the figures) of a support frame of the apparatus 1000, so as to adjust the relative positions of the rollers, from 104*a* to 104*d*, i.e. of the respective rotation axes, from Ra to Rd.

Preferably, the rollers, from 104*a* to 104*d*, are rotatable about the respective rotation axes, from Ra to Rd, by means of a motor-powered system (not shown in the figures). The motor-powered system is preferably configured so that the rotational speed of each roller, from 104*a* to 104*d*, can be adjusted with respect to the rotational speed of the other rollers. The motor-powered system, preferably driven by electric power, can include different configurations, such as for example a system provided with a single motor adapted to drive the rotation of all the rollers through an appropriate transmission assembly. Alternatively, the motor-powered system can comprise a plurality of motors, each of which is associated to a respective roller. According to further embodiments, the motor-powered system can provide for combinations of the preceding configurations, such as for example a first motor adapted to drive the rotation of the pair of feeding rollers, first 104*a* and second 104*b*, and two additional motors adapted to dive the rotation respectively of the intermediate roller 104*c* and of the transfer roller 104*d*. However, these configurations of the motor-powered system are not limitative, and further suitable configurations can be provided.

The rollers, from 104*a* to 104*d*, are arranged in succession, one adjacent and substantially tangent to the other so as to define a rolling mill path LP (shown in FIG. 5 with a double-broken-line) having a rolling mill direction LD (shown in FIG. 5 with a double-line) from the first feeding roller 104*b* toward the transfer roller 104*d* through, in order, the second feeding roller 104*b* and the intermediate roller 104*c*.

In particular, the rollers, from 104*a* to 104*d*, are arranged in succession adjacent and substantially tangent to the other but not in rolling contact with each other so as to leave respective gaps, or pressure lines between two successive adjacent rollers. Such pressure lines between adjacent rollers, from 104*a* to 104*d*, are respectively a feeding pressure line Nf, an intermediate pressure line Ni, and an ending pressure line Ne. The different pressure lines, from Nf to Ne, are configured to substantially press the material that passes through them so as to give to the latter a sheet-like shape having also a desired thickness. In fact, the dimension of each gap or pressure line, from Nf to Ne, can be appropriately adjusted by varying the relative position of the rotation axes, from Ra to Rd, of the four rollers, from 104*a* to 104*d*, by means of appropriate adjusting mechanisms (not shown in the figures). In this manner, it is possible to select the flattening amount to which the material is subjected at each pressure line and, consequently, to define the thickness of the sheet that can be obtained with the apparatus 1000. Preferably, the roller rolling mill system 100 is configured to obtain a sheet having an average/nominal thickness value of less than 1.2 mm (millimeters) and more preferably included between 50 and 500 μm (micrometers).

Figure 5:
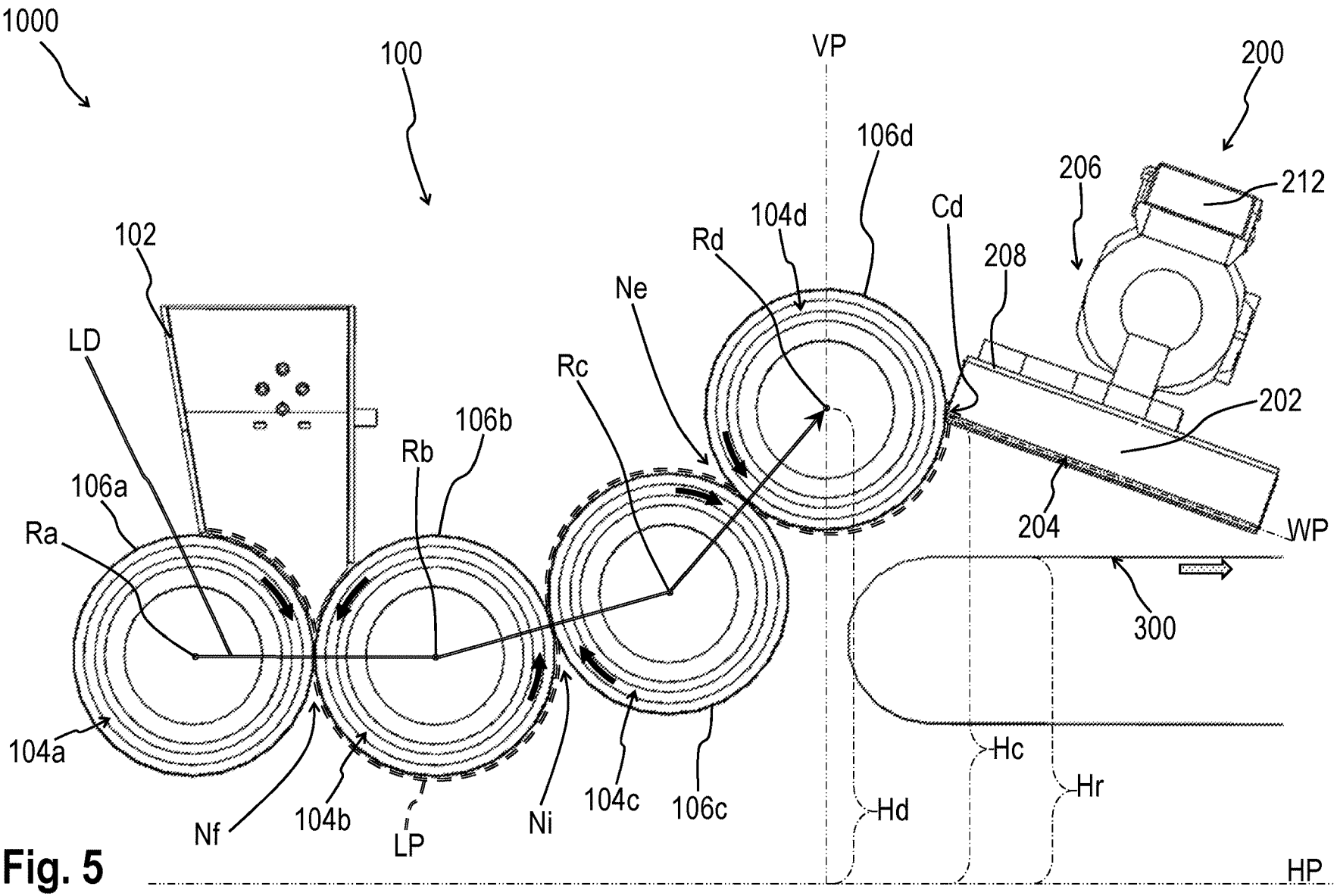
FIG. 5 shows a schematic side view of the apparatus of FIG. 1.

As illustrated by the thick-arrows in FIG. 5, a rotation direction of one roller is opposite to the direction of rotation of the adjacent roller, that is adjacent rollers are adapted to rotate in directions opposite to each other. In particular, the first feeding roller 104*a* and the second feeding roller 104*b* operatively provide for rotation directions opposite to each other, so that one rotates toward the other (a clockwise rotation direction for the first feeding roller 104*a* and counterclockwise for the second feeding roller 104*b* in the side view of FIG. 5). Moreover, the intermediate roller 104*c* operatively provides for an opposite rotation direction with respect to the rotation direction of the second feeding roller 104*b* (a clockwise rotation direction for the intermediate roller 104*c* in the side view of FIG. 5). Instead, the transfer roller 104*d* operatively provides for an opposite rotation direction with respect to the rotation direction of the intermediate roller 104*c* (a counterclockwise rotation direction for the transfer roller 104*d* in the side view of FIG. 5).

The rollers, from 104*a* to 104*d*, are rotated by the motor-powered system in the rotation directions previously defined, having increasing rotation speeds from the first feeding roller 104*a* to the transfer roller 104*d*. In particular, the higher rotation speed of the second feeding roller 104*b* with respect to the first feeding roller 104*a* provides the greater tendency of the material to adhere to the second working surface 106*b* of the second feeding roller 104*b* at the feeding pressure line Nf. Subsequently, the higher rotation speed of the intermediate roller 104*c* with respect to the second feeding roller 104*b* provides the tendency of the material to leave the second working surface 106*b* of the second feeding roller 104*b* and to adhere to the intermediate working surface 106*c* of the intermediate roller 104*c* at the intermediate pressure line Ni. Finally, the higher rotation speed of the transfer roller 104*d* with respect to the intermediate roller 104*c* provides the tendency of the material to leave the intermediate working surface 106*c* of the intermediate roller 104*c* and to adhere to the transfer working surface 106*d* of the transfer roller 104*d* at the ending pressure line Ne.

Preferably, the apparatus 1000 includes a hopper 102 that is open at the respective upper and lower ends. The hopper 102 is arranged above the pair of feeding rollers, first 104*a* and second 104*b*, so as to substantially address the material toward the latter and the feeding pressure line Nf. Therefore, with this construction, the material is supplied to the feeding rollers, first 104*a* and second 104*b*, and falls by gravity through the hopper 102. However, this selection is not limitative and it is possible to provide for other types of supplying means adapted to supply the material to the pair of feeding rollers, first 104*a* and second 104*b*.

Therefore, the rollers, from 104*a* to 104*d*, are arranged in succession adjacent and substantially tangent to each other and are operatively adapted to receive the material that adheres to the respective working surfaces, from 106*a* to 106*d*. In this state, the material is conveyed from a surface of a roller to the surface of the next roller defining the rolling mill path LP having the rolling mill direction LD from the first feeding roller 104*a* toward the transfer roller 104*d* through, in order, the second feeding roller 104*b* and the intermediate roller 104*c*. In particular, along the rolling mill path LP are provided between adjacent rollers the respective pressure lines, from Nf to Ne, that are adapted to substantially press the material so as to impart to the latter a sheet-like shape, having also a desired thickness.

The scraping system 200 is configured to detach from the transfer roller 104*d* the material having said sheet-like shape, so as to preferably supply it to the conveyor means 300.

In particular, the scraping system 200 is configured to engage by contact the transfer working surface 106*d* of the transfer roller 104*d* along a contact line Cd so as to detach the material having said sheet-like shape.

The contact line Cd is substantially parallel to the transfer roller axis Rd and has an extension substantially equal to the height of the cylinder whose side wall defines the transfer working surface 106*d* of the transfer roller 104*d*.

According to the present invention, the scraping system 200 comprises a closed-loop endless scraping band 202. The endless scraping band 202 is operatively adapted to engage the transfer working surface 106*d* of the transfer roller 104*d* along said contact line Cd by means of a scraping edge 204. In particular, the endless scraping band 202 is moved, at said contact line Cd, by means of an actuating assembly 206 parallel to the transfer roller axis Rd of the transfer roller 104*d* (at an allowance of less than about ±0.5 degrees to achieve a proper detachment of the material).

The endless scraping band 202 consists for example of a metal band having a thickness of 0.6 mm and a width of 50 mm and that is also a closed loop, that is, it provides ends that are joined to each other. However, this selection is not limitative and the characteristics of the endless scraping band 202, such as for example materials and dimensions can be appropriately selected according to the application.

The actuating assembly 206 is preferably a pulley-driven actuating assembly comprising two pulleys, first pulley 208 and second pulley 210, one of which is actuated by a motor 212. The endless scraping band 202 is mounted on the two pulleys, first 208 and second 210, and is driven through them by means of the motor 212.

In particular, the scraping system 200 and the actuating assembly 206 are configured so that the scraping edge 204 of the endless scraping band 202 engages the transfer working surface 106*d* of the transfer roller 104*d* along said contact line Cd and, in correspondence of the latter, moves parallel (at an allowance of less than about ±0.5 degrees) to the transfer roller axis Rd of the transfer roller 104*d* (see the double-arrow in the Figs from 1 to 3), as previously mentioned.

In other words, the scraping system 200 and the actuating assembly 206, are configured so that, at the contact line Cd, the endless scraping band 202 moves along a direction substantially orthogonal to the advancement direction of the material into the apparatus 1000, that is along a direction substantially orthogonal to the rolling mill direction LD (see FIG. 5).

In this state, the endless scraping band 202 works substantially as "dynamic" scraping element that engages the transfer working surface 106*d* of the transfer roller 104*d* through consecutive portions that follow each other with a movement along a direction substantially orthogonal to the advancement direction of the material and of the formed sheet.

Therefore, when in a given time interval of the continuous sheet forming process foreign bodies accumulate or deposit on a first portion of the endless scraping band 202 at the contact line Cd, such foreign bodies are moved away from the contact line Cd and, at this point, the engagement with the transfer working surface 106*d* of the transfer roller 104*d* is guaranteed by means of a successive portion of the endless scraping band 202, which is substantially free of foreign bodies.

Consequently, the probability of transferring on the surface of the sheet any foreign bodies that accumulate on the scraping element is reduced or eliminated. In other words, the probability of degrading the quality of the sheet formed by the apparatus 1000 is reduced or eliminated.

Moreover, since the endless scraping band 202 and any foreign bodies that accumulate on it move substantially away from the sheet of material in a direction substantially orthogonal to the advancement direction of the latter, the probability of transferring on the surface of the sheet any foreign bodies that accumulate on the scraping element is further reduced or eliminated.

Furthermore, since at the contact line Cd, there is a decreased probability of having foreign bodies present on the endless scraping band 202, it is possible to reduce the maintenance frequency of the scraping system 200, consequently increasing the productivity of the apparatus 1000. In other words, since the density of foreign bodies present on the entire surface of the endless scraping band 202 is decreased, it is possible to reduce maintenance frequency of the scraping system 200.

Preferably, the actuating assembly 206 is configured so as to move the endless scraping band 202 at said contact line Cd at a speed less than 1.5 m/min (meters per minute), preferably at a speed included between 0.01 and 0.5 m/min (including end-points).

Advantageously, in this state it is possible to effectively detach from the transfer working surface 106*d* of the transfer roller 104*d* the sheet-like material, guaranteeing in a particularly effective manner the reduction or elimination of defects on the surface of the latter. In fact, it has been experimentally verified that when the endless scraping band 202 engages the transfer roller 104*d* at the contact line Cd moving with such speed intervals, the material is detached in an extremely effective manner, further reducing the probability of damaging the structure of the sheet. In particular, speeds greater than 2 m/min, though they can still be appropriate, provide results that are less satisfactory with respect to speeds less than 2 m/min. Moreover, if relatively low speeds are maintained, an excessive increment of the temperature due to friction, which could make it more probable to result in an unwanted degradation of the material with which the sheet is formed, can be prevented.

Preferably, the apparatus 1000 is configured so that the contact line Cd is arranged at an engagement height Hc lower than or equal to an axis height Hd of the transfer roller axis Rd of the transfer roller 104*d*.

In other words, the scraping system 200 is arranged with respect to the transfer roller 104*d* so that the scraping edge 204 of the endless scraping band 202 engages the transfer working surface 106*d* along a contact line Cd that is positioned at a distance from the lying plane HP (engagement height Hc) that is lower than or equal to a distance of the transfer roller axis Rd from the lying plane HP (axis height Hd).

Advantageously, in this state the material having a sheet-like shape is fed to subsequent processing steps by gravity, after having been detached from the transfer working surface 106*d* of the transfer roller 104*d* by means of the scraping system 200. In particular, since the contact line Cd is arranged at an engagement height Hc lower than or equal to the axis height Hd, it is improbable that the sheet-like material, after having been detached, curls up on itself in an undesirable manner.

Moreover, the weight of the portion of material that is detached from the transfer roller 104*d* facilitates the further detachment by means of the scraping system 200, and it is not necessary to provide mechanisms or devices that address the material toward subsequent equipment, such as for example the conveying means 300.

Therefore, in this state the apparatus 1000 provides for a simple construction that, at the same time, guarantees an effective processing of the material.

Moreover, at the same time, this construction allows a simplified maintenance of the apparatus 1000 and its easier coupling with additional equipment for performing subsequent steps, such as for example a drying step for the material.

Preferably, the apparatus 1000 is configured by providing the contact line Cd arranged so that a vertical plane VP (orthogonal to the lying plane HP) on which lies the transfer roller axis Rd of the transfer roller 104*d* is interposed between the contact line Cd and the ending pressure line Ne provided between the transfer roller 104*d* and the previous adjacent roller of the plurality of rollers, from 104*a* to 104*d*, with respect to the rolling mill direction LD, i.e. the intermediate roller 104*c* in the present embodiment.

Advantageously, in this state the apparatus 1000 provides a still simpler construction that, at the same time, guarantees an effective processing of the material. In fact, the scraping system 200 and the actuating assembly 206 can be arranged in areas of the apparatus 1000 that do not interfere with the encumbrances of the conveyor means 300 and the components of the roller rolling mill system 100, such as the plurality of rollers from 104*a* to 104*d*.

Moreover, at the same time, this construction makes it possible to have a still more simplified maintenance of the apparatus 1000 and an easier coupling of the same with any additional equipment for performing successive steps, such as for example a material drying step.

Figure 4:
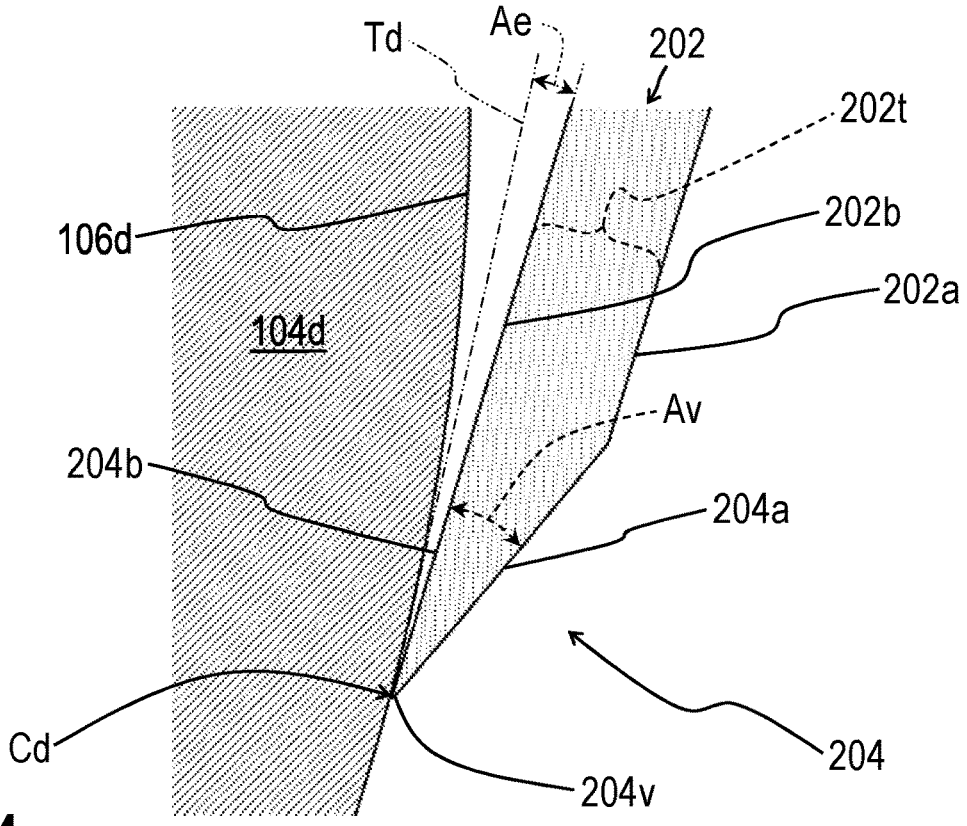
FIG. 4 is an enlarged schematic view at the contact line between the scraping system and the transfer roller of the roller rolling mill system.

Referring in particular to FIG. 4, preferably the apparatus 1000 is configured so that at the contact line Cd the endless scraping band 202 defines an engagement angle Ae of 0.1 to 30 degrees (including end-points) with respect to the tangent plane Td to the transfer working surface 106*d* of the transfer roller 104*d*. More preferably, the engagement angle Ae is from 8 to 12 degrees (including end-points).

Advantageously, in this state it is possible to effectively detach the sheet-like material from the transfer working surface 106*d* of the transfer roller 104*d*. In fact, it has been experimentally verified that when the endless scraping band 202 engages the transfer roller 104*d* at the contact line Cd with such engaging angle intervals, the material is detached effectively without damaging the structure of the sheet.

Referring again to FIG. 4, preferably the endless scraping band 202 comprises two opposing faces, a first face 202*a* and a second face 202*b*, that are parallel and spaced from each other by a thickness 202*t*. The first face 202*a* and the second face 202*b* are connected to each other by said scraping edge 204. In particular, the scraping edge 204 comprises a first edge portion 204*a* and a second edge portion 204*b* that are consecutive to each other and form a polyline so as to define a scraping vertex 204*v*, wherein the second edge portion 202*b* defines said second edge portion 204*b*. With this structure, the scraping edge 204 provides for a scraping vertex 204*v* in which the first edge portion 204*a* and the second edge portion 204*b* define at said scraping vertex 204*v* a vertex angle Av whose bisector line is inclined with respect to the first face 202*a* and to the second surface 202*b*.

Advantageously, with this structure it is possible to effectively detach the sheet-like material from the transfer working surface 106*d* of the transfer roller 104*d*. In fact, it has been experimentally verified that when the scraping edge 204 is provided with said structure, the material is detached in a still more effective manner without damaging the structure of the sheet.

In the most preferred embodiment, the vertex angle Av is from 5 to 45 degrees (including end-points) so as to further effectively guarantee the detachment of material from the transfer working surface 106*d* of the transfer roller 104*d*. More preferably, the vertex angle Av is from 8 to 12 degrees (including end-points).

Moreover, in operative conditions, the endless scraping band 202 is arranged so that the second edge portion 204*b* faces the transfer working surface 106*d* of the transfer roller 104*d* at the contact line Cd.

Advantageously, in this state it is possible to detach still more effectively the sheet-like material from the transfer working surface 106*d* of the transfer roller 104*d*. In fact, it has been experimentally verified that when the scraping edge 204 is provided with such configuration, the material is detached in a still more effective manner without damaging the sheet-like structure.

Referring in particular to FIG. 5, preferably the apparatus 1000 is configured so that the scraping edge 204 of the endless scraping band 202 is moved by the actuating assembly 206 so as to lie and move on a working plane WP that is substantially parallel to the transfer roller axis Rd of the transfer roller 104*d* and, moreover, it is provided with a proper inclination with respect to the lying plane HP.

In particular, according to the first embodiment of the present invention having an even number of rollers in which the direction of rotation of the transfer roller 104*d* is opposite to the direction of rotation of a first feeding roller 104*a* distal with respect to the rolling mill direction LD, the working plane WP is parallel to the lying plane HP or defines with the latter an angle from 0.1 to 45 degrees (including end-points), preferably from 10 to 30 degrees (including end-points).

Advantageously, in this state the apparatus 1000 is provided with an additionally simple construction that, at the same time, guarantees an effective processing of the material. In fact, the scraping system 200 and the actuating assembly 206 can be arranged in areas of the apparatus that do not interfere with the encumbrances of possible conveyor means 300 and of the components of the roller rolling mill system 100, such as the plurality of rollers, from 104*a* to 104*d*.

In a preferred embodiment, the scraping system 200 of the apparatus 1000 further comprises a cleaning device 214 (shown only in FIGS. 1 and 2) that is configured to remove the foreign bodies that adhere to the endless scraping band 202 and/or to its scraping edge 204.

Figure 2:
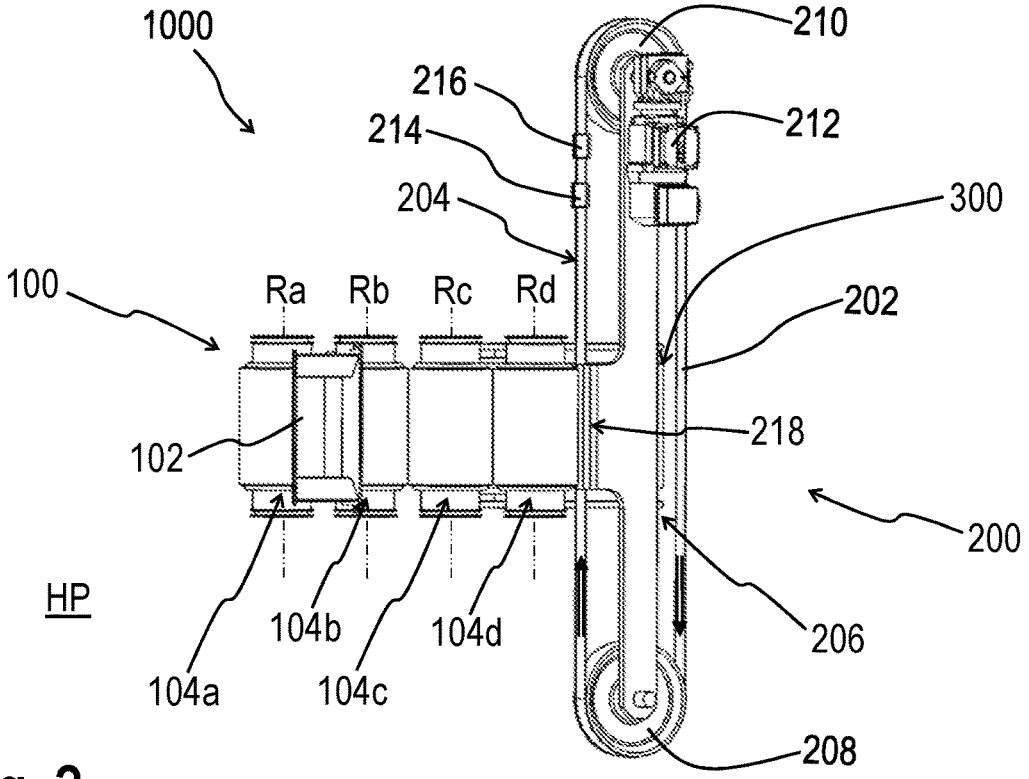
FIG. 2 is a plan view of the apparatus of FIG. 1.

In FIGS. 1 and 2, the cleaning device 214 is shown schematically with a parallelepiped. In particular, it is possible to provide different types of constructions or structures for the cleaning device 214.

For example, it is possible to provide a cleaning device 214 that includes a wall element, formed with an appropriate possibly flexible material that is adapted to engage by means of sliding contact at least one surface of the endless scraping band 202 and/or scraping edge 204. In this state, the movement of the endless scraping band 202 makes it possible to collect and hold the foreign bodies on the wall element.

Alternatively, it is possible to provide a cleaning device 214 that includes at least a brush or cleaning wheel that is adapted to rotate upon itself, by means of a respective motor, engaging by contact at least one surface of the endless scraping band 202 and/or the scraping edge 204. In this state, the rotation of the cleaning brush, together with the movement of the endless scraping band 202, makes it possible to expel the foreign bodies that adhere to the latter.

In case, it is possible to provide a suction system (not shown in the figures) configured to intake the foreign bodies collected or expelled by the endless scraping band 202 by means of a cleaning device 214.

Advantageously, in this state it is possible to guarantee a high degree of cleaning of the endless scraping band 202 at the contact line Cd. Consequently, the probability of transferring onto the surface of the sheet any foreign bodies that accumulate on the scraping element is reduced or eliminated. In other words, the probability of degrading the quality of the sheet obtained by means of the apparatus 1000 is reduced or eliminated.

Moreover, since the foreign bodies are removed in a continuous manner from the endless scraping band 202, a frequency of maintenance of the scraping system 200 is reduced, consequently the productivity of the apparatus 1000 is increased.

In a preferred embodiment, the scraping system 200 of the apparatus 1000 also includes a sharpening device 216 (shown only in FIGS. 1 and 2) which is configured to restore the scraping edge 204 of the scraping band 202 so as to substantially maintain its original shape.

In FIGS. 1 and 2 the sharpening device 216 is shown schematically as a parallelepiped. In particular, it is possible to provide for different types of constructions or structures for the sharpening device 216.

For example, it is possible to foresee a sharpening device 216 that includes at least a sharpening body, formed with a suitable abrasive material, that is adapted to rotate upon itself, by means of a respective motor, engaging by contact the scraping body 204. In this state, the rotation of the sharpening body, together with the movement of the endless scraping band 202, allows the continuous restoring of the shape of the scraping body 204.

In case, it is possible to provide a suction system (not shown in the figures) configured to suck up the waste produced by the grinding of the scraping edge 204 by means of the sharpening device 216.

Advantageously, in this state it is possible to reliably guarantee the maintenance of the shape characteristics of the sharpening edge 204 at the contact line Cd. Consequently, it is increased the reliability of the forming process of the sheet by means of the apparatus 1000.

Moreover, since the scraping edge 204 is restored in a continuous manner, a frequency of maintenance of the scraping system 200 is reduced, consequently increasing the productivity of the apparatus 1000.

In a preferred embodiment, the scraping system 200 of the apparatus 1000 also includes a support device 218 (shown only in FIGS. 1 to 3) that is configured to slidably receive along a direction parallel to the transfer roller axis Rd of the transfer roller 104*d* said endless scraping band 202. In particular, the support device 218 is configured so as to maintain the endless scraping band 202 in a contact relationship with the transfer working surface 106*d* of the transfer roller 104*d* at the contact line Cd through the scraping edge 204, having a given desired pressure and/or tilt with respect to the lying plane HP.

Figure 3:
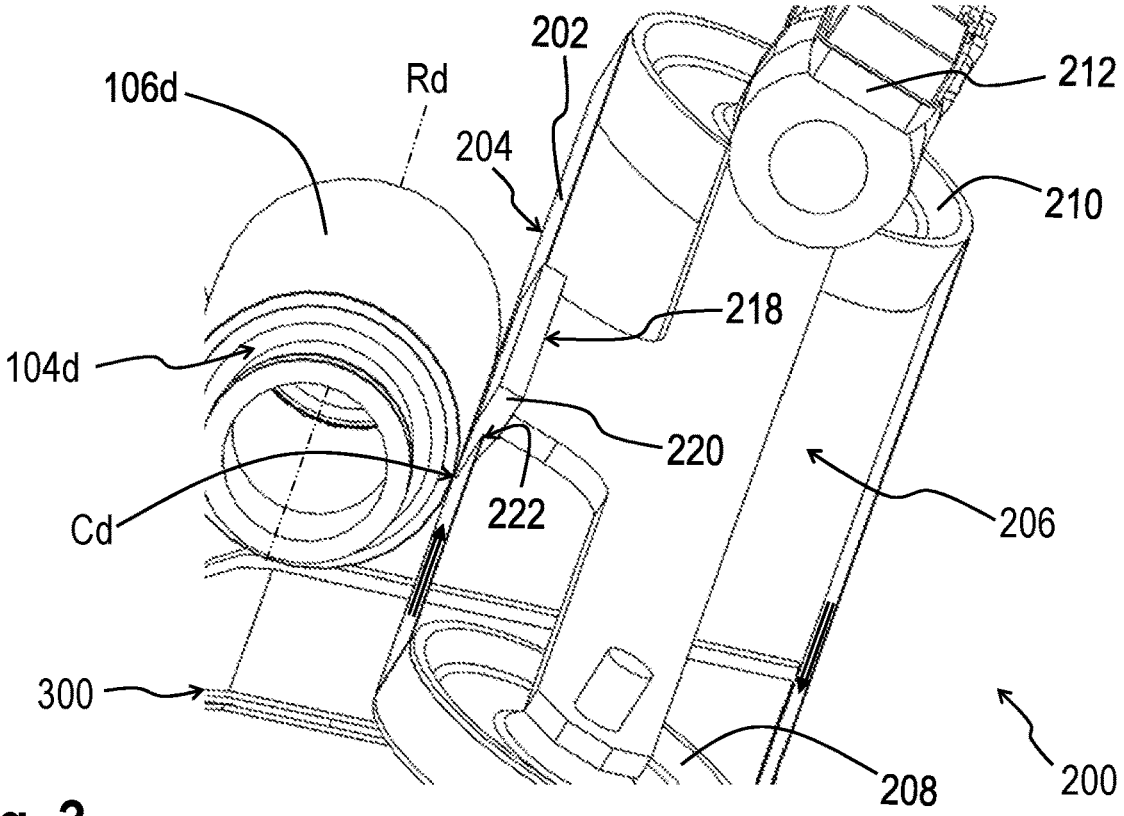
FIG. 3 is an enlarged view of the apparatus of FIG. 1 at a contact line between a scraping system and a transfer roller of a roller rolling mill system.

FIGS. 1 to 3 show a preferred embodiment of the support device 218, but it is clear that the latter can comprise different types of constructions or structures.

In the present embodiment, the support device 218 includes a support body 220 fixed to a frame (the latter not numbered in the figures) close to the transfer working surfaces 106*d* of the transfer roller 104*d*. The support body 220 is provided with a longitudinal groove 222 configured to slidably receive the endless scraping band 202 along a direction parallel to the transfer roller axis Rd of the transfer roller 104*d*. In particular, the support body 220 is arranged so that the scraping edge 204 is operatively in a contact relationship with the transfer working surface 106*d* of the transfer roller 104*d* with a given pressure and/or tilt, such as a desired engagement angle Ae of the endless scraping band 202 with respect to the tangent plane Td to the transfer working surface 106*d* at the contact line Cd.

Advantageously, in this state it is possible to reliably guarantee a detachment step of the material from the transfer working surface 106*d* of the transfer roller 104*d* by means of the scraping band 202 of the scraping system 200. In particular, by maintaining a steady pressure and/or tilt of the scraping band 202 at the contact line Cd, it is possible to maintain in a reliable manner a desired processing condition, based for example on the mechanical characteristics of the material with which the sheet is formed.

As previously mentioned, the apparatus 1000 preferably comprises conveyor means 300 that are configured to receive and carry the material having said sheet-like shape, when it is separated from the transfer working surface 106*d* of the transfer roller 104*d* (see the thick-dotted-arrow in FIG. 5 that indicates the direction of transportation). In particular, the conveyor means 300 are adapted to receive the material in a sheet-like shape at a receiving height Hr that is lower than the engagement height Hc of the contact line Cd.

Preferably, the conveyor means 300 and the transfer roller 104*d* are at least partially in a overlapping relationship to each other when seen along a direction orthogonal to the lying plane HP. In other words, when seen in a plan view, the conveyor means 300 and the transfer roller 104*d* are at least partially superimposed on each other.

Advantageously, in this state, the sheet-like material is supplied to the conveyor means 300 by force of gravity, after having been detached by the scraping system 200, thus avoiding the use of additional mechanism or devices to address the material.

Below is described a further embodiment of the present invention that provides modifications relative to some components of the apparatus 1000. Thus, the components that are substantially unvaried will not be described again in the specific and the same numerical references will be used.

Figure 6:
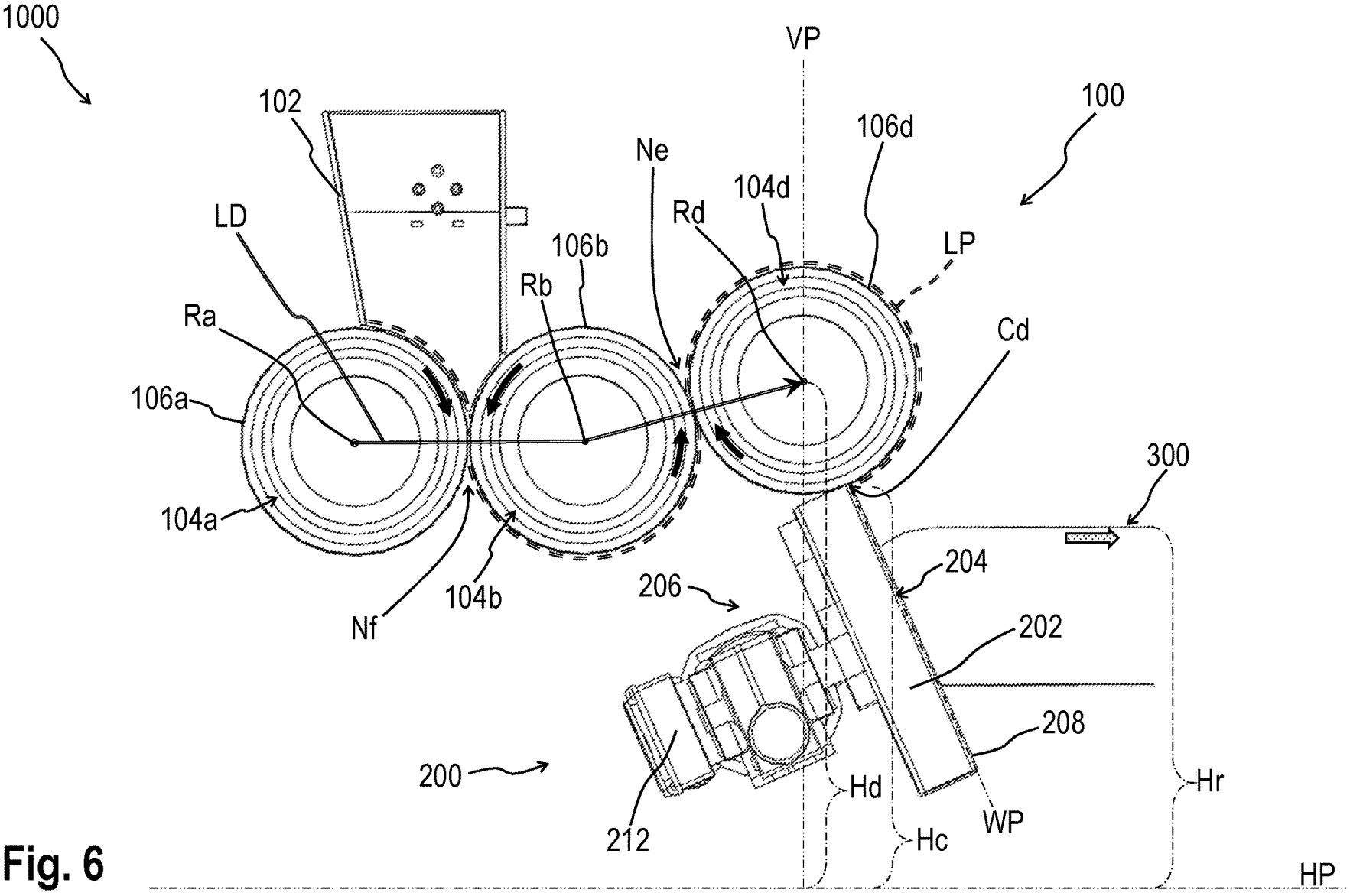
FIG. 6 shows a schematic side view of an apparatus according to a second preferred embodiment of the present invention.

With reference to FIG. 6, is shown an apparatus 1000 for making a sheet with material comprising vegetable and/or alkaloid substances, according to a second preferred embodiment of the present invention. In the second embodiment, the apparatus 1000 is substantially identical to the first embodiment, with the exception of the position and orientation of the scraping system 200 with respect to the roller rolling mill system 100, and to the number of rollers of the latter.

In particular, unlike the first embodiment, the roller rolling mill system 100 comprises three rollers. The three rollers include, in succession in the following order, the pair of feeding rollers, first feeding roller 104*a* and second feeding roller 104*b*, and the transfer roller 104*d*. In other words, unlike the first embodiment, the roller rolling mill system 100 does not include the intermediate roller 104*c*.

As in the first embodiment the three rollers, 104*a*, 104*b* and 104*d*, are arranged in succession one adjacent and substantially tangent to the other defining the rolling mill path LP (shown in FIG. 6 with a broken-double-line) having the rolling mill direction LD (shown in FIG. 6 with a double-line) from the first rolling mill roller 104*a* toward the transfer roller 104*d* though the second feeding roller 104*b*.

In particular, like in the first embodiment, the tree rollers, 104*a*, 104*b* and 104*d*, are arranged in succession one adjacent and substantially tangent to the other through pressure lines between two successive adjacent rollers. These pressure lines between adjacent rollers, 104*a*, 104*b* and 104*d*, are respectively the feeding pressure line Nf and the ending pressure line Ne.

As in the first embodiment, the scraping system 200 is configured to engage the transfer working surface 106*d* of the transfer roller 104*d* along the contact line Cd so as to detach the material having said sheet-like shape.

The scraping system 200 includes a closed-loop endless scraping band 202. The endless scraping band 202 is operatively adapted to engage the transfer working surface 106*d* of the transfer roller 104*d* along said contact line Cd by means of the scraping edge 204. In particular, the endless scraping band 202, or its scraping edge 204, is movable at said contact line Cd by means of the actuating assembly 206 parallel (that is, along a direction parallel) to the transfer roller axis Rd of the transfer roller 104*d* (at an allowance of about ±0.5 degrees to achieve a proper detachment of the material).

Like in the first embodiment, the apparatus 1000 in the second embodiment is preferably configured so that the contact line Cd is arranged at an engagement height Hc that is lower than or equal to an axis height Hd of the transfer roller axis Rd of the transfer roller 104*d*.

Moreover, the apparatus 1000 in the second embodiment is preferably configured by providing the contact line Cd arranged so that the vertical plane VP (orthogonal to the lying plane HP) on on which lies the transfer roller axis Rd of the transfer roller 104*d*, is interposed between the contact line Cd and the ending pressure line Ne provided between the transfer roller 104*d* and the previous adjacent roller of the plurality of rollers with respect to the rolling mill direction LD, i.e. the second feeding roller 104*b* in the present second embodiment.

In this state, the apparatus 1000 provides the same advantages provided in the first embodiment that have been previously described. In particular, all the preferred aspects provided for in the first embodiment can also be provided in the second embodiment, such as configuration of the scraping edge 204, and the use of the previously described cleaning, sharpening and support devices.

Moreover, according to the second embodiment of the present invention that provides for an odd number of rollers in which the direction of rotation of the transfer roller 104*d* is equal to the direction of rotation of the first feeding roller 104*a* distal with respect to the roller rolling mill direction LD, the working plane WP defines with the lying plane HP an angle of 45 to 90 degrees (lesser end-point not included, higher end-point included), preferably from 60 to 80 degrees (including end-points).

Advantageously, in this state the apparatus 1000 provides for a still simpler construction that, at the same time, guarantees an effective processing of the material. In fact, the scraping system 200 and the actuating assembly 206 can be arranged in areas of the apparatus 1000 that do not interfere with the encumbrances of the conveyor means 300 and of the components of the roller rolling mill system 100, such as the plurality of rollers 104*a*, 104*b* and 104*d*.

In particular, it appears clear from the two previously described embodiments that the construction of the apparatus 1000 and of the scraping system 200, according to the present invention, allow in the design phase versatility of the configuration of the roller rolling mill system 100 based on the number and the arrangement of the rollers.

It is clear that it is possible to have additional embodiments of the apparatus 1000 with respect to what has been described heretofore, without departing from the claimed scope of protection.

In fact, in the previous description the apparatus 1000 provides for a roller rolling mill system 100 having three or four rollers. However, these configurations are not limitative, and the number of rollers can be any number greater than or equal to two.

Moreover, the relative arrangement of the rollers that define the rolling mill path LP and the rolling mill direction LD can be appropriately selected on the basis of the application and of a constructive convenience. For example, the rollers of the roller rolling mill system 100 can be arranged so as to define a rectilinear rolling mill direction LD that is arranged parallel to the lying plane HP. Alternatively, the plurality of rollers of the roller rolling mill system 100 can be arranged so as to define a rolling mill direction LD that is substantially curved upward (as in the previous first and second embodiments), downward, in a zig-zag manner, or the like, or combinations thereof.

In particular, independently of the construction of the roller rolling mill system 100, the scraping system 200, according to the present invention, provides the advantages described previously.

Moreover, although the previous description refers to a scraping system 200 in which the actuating assembly 206 includes two pulleys, first pulley 208 and second pulley 210, it appears clear that the number of pulleys can be appropriately selected. In particular, it is possible to provide additional embodiment in which the number of pulleys is more than two and the endless scraping band 202 moves along a circuit defined by them. In this manner, in the design phase, it is possible to appropriately select the arrangement of the components of the scraping system 200, such as for example the motor 212, with respect to the roller rolling system 100 and to the conveyor means 300, so as to facilitate the accessibility to the components in the maintenance phase.

Moreover, it is possible to provide embodiments of the apparatus 1000 that provide for further components.

For example, it is possible to provide for an apparatus 1000 comprising at least one segmenting roller arranged substantially tangent to the transfer roller 104*d*. In particular, said segmenting roller is superficially provided with cutting ribs and is configured to cut the sheet adhering to the transfer working surface 106*d* of the transfer roller 104*d* into a plurality of segments placed side-by-side to each other. Therefore, with this configuration the scraping system 200 is configured to detach a cut sheet from the transfer roller 104*d*.

Moreover, it is possible to provide for an apparatus 1000 comprising distributing means to evenly distribute the material along the feeding pressure line Nf parallel to the rotation axes, first Ra and second Rb, of the pair of feeding rollers, first 104*a* and second 104*b*.

In addition, it is possible to provide for an apparatus 1000 in which the scraping system 200 is installed on a portion of a mobile-frame, for example through hinge elements, so as to further facilitate a maintenance phase.

From what has been thus far described, it is evident that important results have been achieved, overcoming the drawback of the prior art, making it possible to make an apparatus 1000 configured to effectively form a sheet with material comprising vegetable and/or alkaloid substances.

In fact, the apparatus 1000 is configured to guarantee a reduction or an elimination of defects on the surface of the formed sheet thanks to the specific construction of the scraping system 200.

Moreover, the apparatus 1000 allows, in the design phase, versatility of configuration on the basis of desired characteristics of the roller rolling mill system 100.

In addition, the apparatus 1000 provides for a simple construction that also requires a simple maintenance.

Finally, the apparatus 1000 guarantees a high productivity.

Naturally, the materials and equipment used to implement the present invention, as well as the shape and dimensions of the individual components, can be the most appropriate for the specific requirements.

The invention claimed is:

1. An apparatus for making a sheet of material comprising vegetable and/or alkaloid substances, the apparatus including:

a roller rolling mill system comprising a plurality of rollers rotatable about respective rotation axes parallel to each other, the rollers being operatively adapted to receive the material adhering to respective working surfaces, and the rollers being further arranged in succession one adjacent and substantially tangent to the other defining a rolling mill path having a rolling mill direction, wherein a rotation direction of a roller is opposite to the rotation direction of the adjacent roller, along the rolling mill path being provided between two adjacent rollers respective pressure lines substantially adapted to press the material so as to provide the latter with a sheet-like shape, a scraping system configured to engage by contact the working surface of a transfer roller of the plurality of rollers along a contact line so as to detach the material having the sheet-like shape from the transfer roller, wherein the scraping system comprises a closed-loop endless scraping band operatively adapted to engage the working surface of the transfer roller along the contact line by means of a scraping edge, the endless scraping band being movable at the contact line parallel to the rotation axis of the transfer roller by means of an actuating assembly.

2. The apparatus according to claim 1, wherein the contact line is arranged at an engagement height lower than or equal to an axis height of the rotation axis of the transfer roller.

3. The apparatus according to claim 2, wherein the contact line is arranged so that a vertical plane on which lies the rotation axis of the transfer roller is interposed between the contact line and the ending pressure line between the transfer roller and the previous adjacent roller of the plurality of rollers.

4. The apparatus according to claim 1, wherein the actuating assembly is configured to move the endless scraping band at the contact line at a speed less than 1.5 m/min, or at a speed of 0.01 to 0.5 m/min.

5. The apparatus according to claim 1, wherein at the contact line the endless scraping band defines with respect to the tangent plane to the working surface of the transfer roller an engagement angle of 0.1 to 30 degrees.

6. The apparatus according to claim 1, wherein the endless scraping band comprises a first face and a second face parallel and spaced from each other by a thickness, the first face and the second face being connected to each other by the scraping edge, the scraping edge comprising a first edge portion and a second edge portion consecutive to each other so as to define a scraping vertex, wherein the second face defines the second edge portion, the first edge portion and the second edge portion defining at the scraping vertex a vertex angle of 5 to 45 degrees, and the second edge portion operatively facing towards the working surface of the transfer roller at the contact line.

7. The apparatus according to claim 1, wherein the actuating assembly comprises at least a first pulley and a second pulley adapted to actuate the endless scraping band so that the scraping edge lies on a working plane, wherein when the rotation direction of the transfer roller is opposite to the rotation direction of a first feeding roller distal with respect the rolling mill direction of the plurality of rollers, the working plane is parallel to a lying plane or defines with the latter an angle of 0.1 to 45 degrees, or when the rotation direction of the transfer roller is equal to the rotation direction of the first feeding roller distal with respect the rolling mill direction of the plurality of rollers, the working plane defines with the lying plane an angle of 45 to 90 degrees.

8. The apparatus according to claim 1, wherein the scraping system comprises a cleaning device configured to remove foreign bodies adhering to the endless scraping band and/or to the scraping edge.

9. The apparatus according to claim 1, wherein the scraping system comprises a sharpening device configured to restore the scraping edge of the endless scraping band.

10. The apparatus according to claim 1, wherein the scraping system comprises a support device configured to slidably receive along a direction parallel to the rotation axis of the transfer roller the endless scraping band so as to keep the latter in a contact relationship with the working surface of the transfer roller at the contact line through the scraping edge having a given pressure and/or tilt.

11. The apparatus according to claim 1, comprising conveyor means configured to receive and move the material having the sheet-like shape when detached from the working surface of the transfer roller, the conveyor means being adapted to receive the material at a receiving height lower than an engagement height of the contact line, wherein the conveyor means and the transfer roller are at least partially in an overlapping relationship with each other when viewed in a plan view.

* * * * *